US006212778B1

(12) United States Patent
Carter

(10) Patent No.: US 6,212,778 B1
(45) Date of Patent: Apr. 10, 2001

(54) PLASTER CUTTING DEVICE

(76) Inventor: Thomas F. Carter, 5 Argyle Rd., Randolph, MA (US) 02368

( * ) Notice: Subject to any disclaimer, the term of this patent is extended or adjusted under 35 U.S.C. 154(b) by 0 days.

(21) Appl. No.: 09/349,294

(22) Filed: Jul. 8, 1999

(51) Int. Cl.[7] ..... A47L 13/02

(52) U.S. Cl. ..... 30/136.5; 30/124; 30/169; 451/456

(58) Field of Search ..... 30/124, 125, 136, 30/136.5, 169, 170, 172, 475, 476; 125/9; 299/39.9, 39.1, 43; 15/236.1; 451/451, 453, 455, 456, 523, 524, 354

(56) References Cited

U.S. PATENT DOCUMENTS 3,180,063 * 4/1965 Burrows et al. ..... 451/456 X 3,443,613 * 5/1969 Roods ..... 30/475

* cited by examiner

*Primary Examiner*—Douglas D. Watts

(57) ABSTRACT

A new plaster cutting device for cutting grooves into cracked portions of ceilings and walls. The inventive device includes a housing having a hollow interior. The hollow interior has a forward chamber and a rearward chamber. An elongated handle extends angularly upward from the housing. The elongated handle has a hollow interior. A motor is secured within the rearward chamber of the housing. The motor has a rotatable gear disposed on an end thereof. A cylindrical wheel is rotatably disposed within the forward chamber of the housing. The cylindrical wheel has a plurality of cutting teeth disposed thereon. The cylindrical wheel has a gear disposed on an end thereof. A belt extends around the rotatable gear of the motor and the gear of the cylindrical wheel whereby activation of the motor will facilitate rotation of the cylindrical wheel.

9 Claims, 2 Drawing Sheets

PLASTER CUTTING DEVICE

BACKGROUND OF THE INVENTION

1. Field of the Invention

The present invention relates to cutting tools and more particularly pertains to a new plaster cutting device for cutting grooves into cracked portions of ceilings and walls.

2. Description of the Prior Art

The use of cutting tools is known in the prior art. More specifically, cutting tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art cutting tools include U.S. Pat. No. 4,839,966 to Krouzkevitch et al.; U.S. Pat. No. 4,860,450 to Achille; U.S. Pat. No. Des. 337,037 to Yelton; U.S. Pat. No. 4,938,201 to Chiuminatta et al.; U.S. Pat. No. 5,381,780 to Yelton et al.; and U.S. Pat. No. 4,360,048 to Schadlich et al.

While these devices fulfill their respective, particular objectives and requirements, the aforementioned patents do not disclose a new plaster cutting device. The inventive device includes a housing having a hollow interior. The hollow interior has a forward chamber and a rearward chamber. An elongated handle extends angularly upward from the housing. The elongated handle has a hollow interior. A motor is secured within the rearward chamber of the housing. The motor has a rotatable gear disposed on an end thereof. A cylindrical wheel is rotatably disposed within the forward chamber of the housing. The cylindrical wheel has a plurality of cutting teeth disposed thereon. The cylindrical wheel has a gear disposed on an end thereof. A belt extends around the rotatable gear of the motor and the gear of the cylindrical wheel whereby activation of the motor will facilitate rotation of the cylindrical wheel.

In these respects, the plaster cutting device according to the present invention substantially departs from the conventional concepts and designs of the prior art, and in so doing provides an apparatus primarily developed for the purpose of cutting grooves into cracked portions of ceilings and walls.

SUMMARY OF THE INVENTION

In view of the foregoing disadvantages inherent in the known types of cutting tools now present in the prior art, the present invention provides a new plaster cutting device construction wherein the same can be utilized for cutting grooves into cracked portions of ceilings and walls.

The general purpose of the present invention, which will be described subsequently in greater detail, is to provide a new plaster cutting device apparatus and method which has many of the advantages of the cutting tools mentioned heretofore and many novel features that result in a new plaster cutting device which is not anticipated, rendered obvious, suggested, or even implied by any of the prior art cutting tools, either alone or in any combination thereof.

To attain this, the present invention generally comprises a housing having a generally square configuration. The housing has a closed upper end, an open bottom end, an arcuate forward wall, an open rear wall, opposed side walls and a hollow interior. The closed upper end has an opening therethrough. The hollow interior has a forward chamber and a rearward chamber. The forward chamber is contiguous with the opening in the closed upper end and the open bottom end. An elongated handle extends angularly upward from the open rear wall of the housing. The elongated handle has a hollow interior. A motor is secured within the rearward chamber of the housing. The motor has a rotatable gear disposed on an end thereof. A cylindrical wheel is rotatably disposed within the forward chamber of the housing. The cylindrical wheel has a plurality of cutting teeth disposed thereon. The cutting teeth are arranged in a plurality of linear rows across an outer surface thereof whereby a single row of teeth are disposed outwardly of the open bottom end of the housing. The cylindrical wheel has a gear disposed on an end thereof. A belt extends around the rotatable gear of the motor and the gear of the cylindrical wheel whereby activation of the motor will facilitate rotation of the cylindrical wheel. A collection cover is removably coupled with the opening in the closed upper end of the housing. The collection cover has an open inner end for receiving debris therein. A power switch is disposed within the elongated handle. The power switch is in communication with the motor. A battery is disposed within the elongated handle. The battery is in communication with the power switch. A depth gauge is secured to the opposed side walls of the housing. The depth gauge has a planar lower edge disposed on a plane slightly below the open bottom end of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new plaster cutting device apparatus and method which has many of the advantages of the cutting tools mentioned heretofore and many novel features that result in a new plaster cutting device which is not anticipated, rendered obvious, suggested, or even implied by any of the prior art cutting tools, either alone or in any combination thereof.

It is another object of the present invention to provide a new plaster cutting device which may be easily and efficiently manufactured and marketed.

It is a further object of the present invention to provide a new plaster cutting device which is of a durable and reliable construction.

An even further object of the present invention is to provide a new plaster cutting device which is susceptible of a low cost of manufacture with regard to both materials and labor, and which accordingly is then susceptible of low prices of sale to the consuming public, thereby making Such plaster cutting device economically available to the buying public.

Still yet another object of the present invention is to provide a new plaster cutting device which provides in the apparatuses and methods of the prior art some of the advantages thereof, while simultaneously overcoming some of the disadvantages normally associated therewith.

Still another object of the present invention is to provide a new plaster cutting device for cutting grooves into cracked portions of ceilings and walls.

Yet another object of the present invention is to provide a new plaster cutting device which includes a housing having a hollow interior. The hollow interior has a forward chamber and a rearward chamber. An elongated handle extends angularly upward from the housing. The elongated handle has a hollow interior. A motor is secured within the rearward chamber of the housing. The motor has a rotatable gear disposed on an end thereof. A cylindrical wheel is rotatably disposed within the forward chamber of the housing. The cylindrical wheel has a plurality of cutting teeth disposed thereon. The cylindrical wheel has a gear disposed on an end thereof. A belt extends around the rotatable gear of the motor and the gear of the cylindrical wheel whereby activation of the motor will facilitate rotation of the cylindrical wheel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
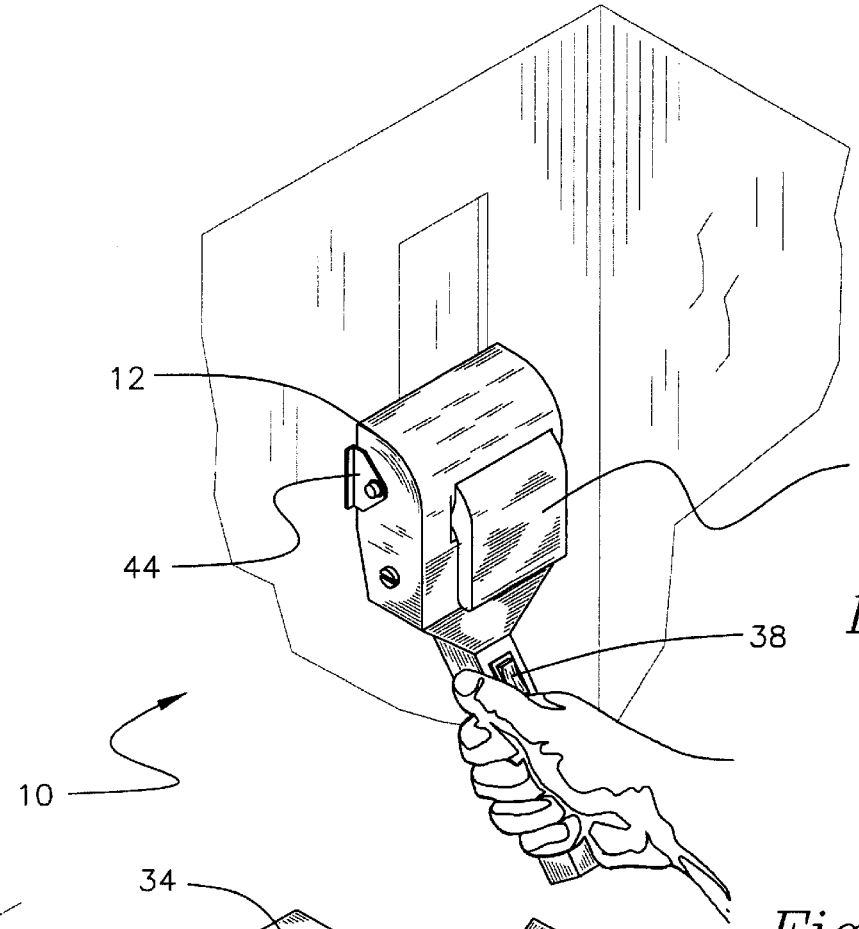
FIG. 1 is a perspective view of a new plaster cutting device according to the present invention illustrated in use.
Figure 2:
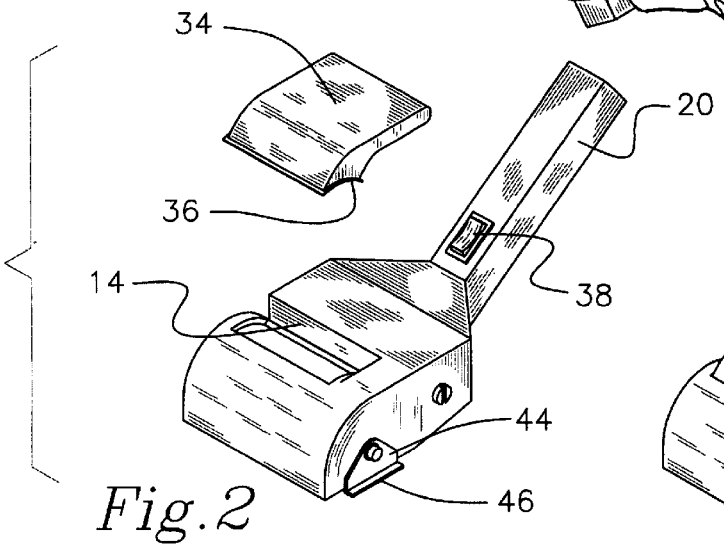
FIG. 2 is a perspective view of the present invention shown with the collector removed.
Figure 3:
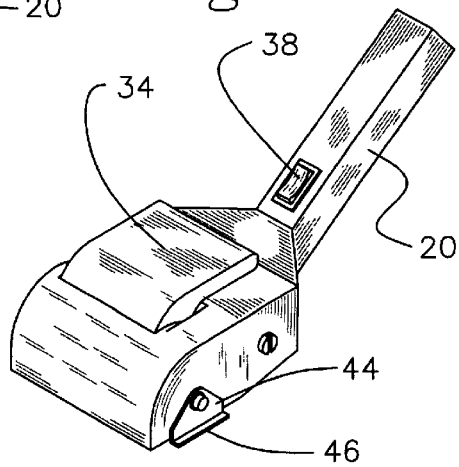
FIG. 3 is a perspective view of the present invention shown with the collector in place.
Figure 4:
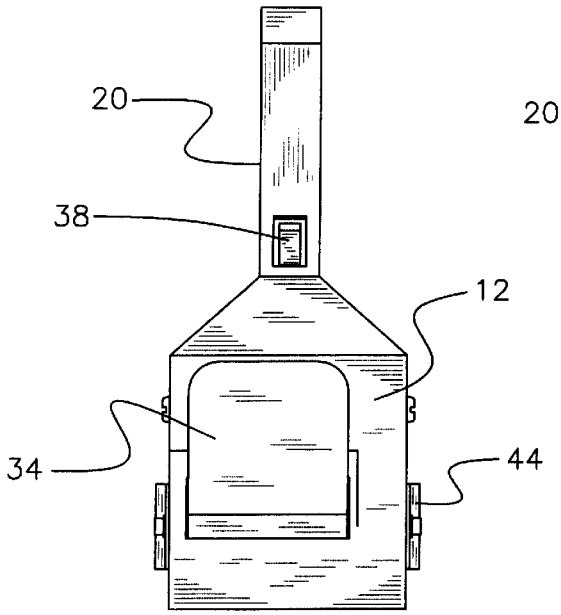
FIG. 4 is a top plan view of the present invention.
Figure 5:
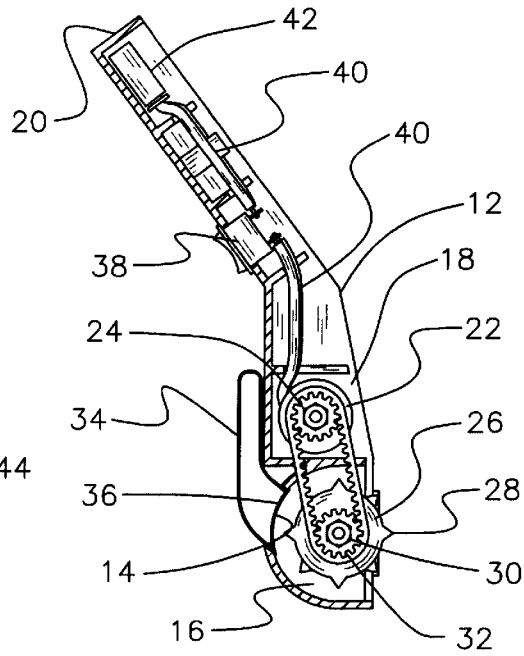
FIG. 5 is a cross-sectional side view of the present invention.
Figure 6:
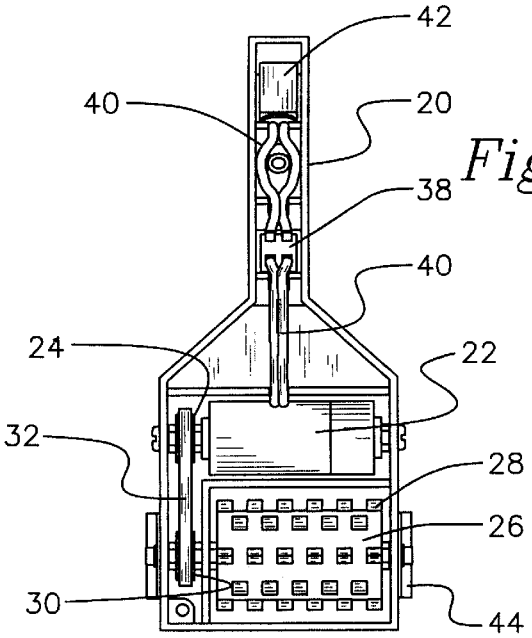
FIG. 6 is a cross-sectional top plan view of the present invention.
Figure 7:
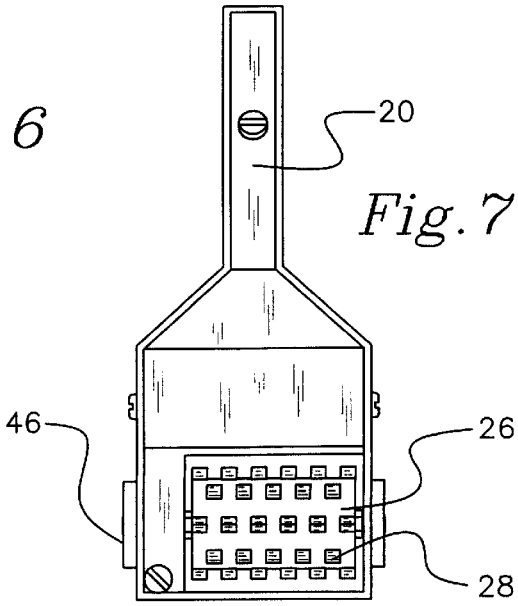
FIG. 7 is a bottom plan view of the present invention.

With reference now to the drawings, and in particular to FIGS. 1 through 7 thereof, a new plaster cutting device embodying the principles and concepts of the present invention and generally designated by the reference numeral 10 will be described.

As best illustrated in FIGS. 1 through 7, the plaster cutting device 10 comprises a housing 12 having a generally square configuration. The housing 12 has a closed upper end, an open bottom end, an arcuate forward wall, an open rear wall, opposed side walls and a hollow interior. The closed upper end has an opening 14 therethrough. The hollow interior has a forward chamber 16 and a rearward chamber 18. The forward chamber 16 is contiguous with the opening 14 in the closed upper end and the open bottom end.

An elongated handle 20 extends angularly upward from the open rear wall of the housing 12. The elongated handle 20 has a hollow interior.

A motor 22 is secured within the rearward chamber 18 of the housing 12. The motor 22 has a rotatable gear 24 disposed on an end thereof.

A cylindrical wheel 26 is rotatably disposed within the forward chamber 16 of the housing 12. The cylindrical wheel 26 has a plurality of cutting teeth 28 disposed thereon. The cutting teeth 28 are arranged in a plurality of linear rows across an outer surface thereof whereby a single row of teeth are disposed outwardly of the open bottom end of the housing 12. The cylindrical wheel 26 has a gear 30 disposed on an end thereof. A belt 32 extends around the rotatable gear 24 of the motor 22 and the gear 30 of the cylindrical wheel 26 whereby activation of the motor 22 will facilitate rotation of the cylindrical wheel 26.

A collection cover 34 is removably coupled with the opening 14 in the closed upper end of the housing 12. The collection cover 34 has an open inner end 36 for receiving debris therein.

A power switch 38 is disposed within the elongated handle 20. The power switch 38 is in communication with the motor 22. The power switch has wiring 40 extending in communication with the motor 22.

A battery 42 is disposed within the elongated handle 20. The battery 42 is in communication with the power switch 38. The wiring 40 also extends between the battery and the power switch 38. Thus, the batter 42 powers the motor 22.

A depth gauge 44 is secured to the opposed side walls of the housing 12. The depth gauge 44 has a planar lower edge 46 disposed on a plane slightly below the open bottom end of the housing 12.

In use, the device 10 is a battery-powered hand tool used to cut grooves into cracked portions of ceilings and wall to allow for their repair. The sharp teeth 28 on the cylindrical wheel 26 would preferably cut a 2½ inch wide and ¼ inch deep groove into the drywall or plaster walls or ceiling. The depth gauge 44 would allow the user of the device 10 to know how deeply they had penetrated into the wall or ceiling. The angular orientation of the elongated handle 20 allows the user to conveniently hold the device 10 as well as have access to the power switch 38 at the same time. As the cutting teeth 28 are cutting into the drywall or plaster, the debris from the cutting will collect in the collection cover 34. The collection cover 34 is easily removable to allow for easy disposal of the debris.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new plaster cutting device for cutting grooves into cracked portions of ceilings and walls comprising, in combination:

a housing having a generally square configuration, the housing having a closed upper end, an open bottom end, an arcuate forward wall, an open rear wall, opposed side walls and a hollow interior, the closed upper end having an opening therethrough, the hollow interior having a forward chamber and a rearward chamber, the forward chamber being contiguous with the opening in the closed upper end and the open bottom end;

an elongated handle extending angularly upward from the open rear wall of the housing, the elongated handle having a hollow interior;

a motor secured within the rearward chamber of the housing, the motor having a rotatable gear disposed on an end thereof;

a cylindrical wheel rotatably disposed within the forward chamber of the housing, the cylindrical wheel having a plurality of cutting teeth disposed thereon, the cutting teeth being arranged in a plurality of linear rows across an outer surface thereof whereby a single row of teeth are disposed outwardly of the open bottom end of the housing, the cylindrical wheel having a gear disposed on an end thereof, a belt extending around the rotatable gear of the motor and the gear of the cylindrical wheel whereby activation of the motor will facilitate rotation of the cylindrical wheel;

a collection cover removably coupled with the opening in the closed upper end of the housing, the collection cover having an open inner end for receiving debris therein;

a power switch disposed within the elongated handle, the power switch being in communication with the motor;

a battery disposed within the elongated handle, the battery being in communication with the power switch; and a depth gauge secured to the opposed side walls of the housing, the depth gauge having a planar lower edge disposed on a plane slightly below the open bottom end of the housing.

2. A new plaster cutting device for cutting grooves into cracked portions of ceilings and walls comprising, in combination:

a housing having a hollow interior, the hollow interior having a forward chamber and a rearward chamber;

an elongated handle extending angularly upward from the housing, the elongated handle having a hollow interior;

a motor secured within the rearward chamber of the housing, the motor having a rotatable gear disposed on an end thereof;

a cylindrical wheel rotatably disposed within the forward chamber of the housing, the cylindrical wheel having a plurality of cutting teeth disposed thereon, the cylindrical wheel having a gear disposed on an end thereof, a belt extending around the rotatable gear of the motor and the gear of the cylindrical wheel whereby activation of the motor will facilitate rotation of the cylindrical wheel; and a depth gauge secured to opposed side walls of the housing, the depth gauge having a planar lower edge disposed on a plane slightly below a bottom end of the housing.

3. The plaster cutting device as set forth in claim 2 and further including a collection cover removably coupled with an opening formed in an upper end of the housing, the collection cover having an open inner end for receiving debris therein.

4. The plaster cutting device as set forth in claim 2 and further including a power switch disposed within the elongated handle, the power switch being in communication with the motor.

5. The plaster cutting device as set forth in claim 4 and further including a battery disposed within the elongated handle, the battery being in communication with the power switch.

6. A plaster cutting device for cutting grooves into cracked portions of ceilings and walls comprising:

a housing having an interior, the interior having a forward chamber and a rearward chamber;

an elongated handle extending from the housing, the elongated handle having an interior;

a motor secured in the rearward chamber of the housing, a rotatable first drive member being mounted on a shaft of the motor for rotation with the shaft;

a substantially cylindrical wheel rotatably mounted in the forward chamber of the housing, the wheel having a plurality of cutting teeth disposed thereon, a rotatable second drive member being mounted on the wheel for rotation with the wheel, a belt extending around the first and second drive members such that rotation of the first drive member causes rotation of the second drive member; and a depth gauge secured to spaced side walls of the housing, the depth gauge having a lower edge adapted for resting on a surface, the lower edge of each of the depth gauges extending adjacent to an end of the wheel.

7. The plaster cutting device as set forth in claim 6 and further including a collection cover removably coupled to the housing in communication with an opening extending into the forward chamber of the housing, the collection cover having an open inner end for receiving debris therein.

8. The plaster cutting device as set forth in claim 6 and further including a power switch mounted on the elongated handle in electrical communication with the motor.

9. The plaster cutting device as set forth in claim 8 and further including a battery disposed in the handle, the battery being in communication with the power switch.

* * * * *